United States Patent [19]

Bleickert

[11] Patent Number: 4,741,514

[45] Date of Patent: May 3, 1988

[54] HIGH TEMPERATURE AND/OR MELTING FURNACE FOR NON-FERROUS METALS WITH DOSING DEVICE

[76] Inventor: Gerhard Bleickert, Kaiserstr. 3, D-6920 Sinsheim, Fed. Rep. of Germany

[21] Appl. No.: 785,361

[22] PCT Filed: Jun. 20, 1984

[86] PCT No.: PCT/EP84/00192

§ 371 Date: Oct. 4, 1985

§ 102(e) Date: Oct. 4, 1985

[87] PCT Pub. No.: WO85/03656

PCT Pub. Date: Aug. 29, 1985

[30] Foreign Application Priority Data

Feb. 23, 1984 [DE] Fed. Rep. of Germany ..... 3406467

[51] Int. Cl.[4] ..... C22B 9/16

[52] U.S. Cl. ..... 266/239; 266/242

[58] Field of Search ..... 266/239, 242, 90, 78, 266/236, 200; 222/595, 596, 603

[56] References Cited

U.S. PATENT DOCUMENTS 2,058,378 10/1936 Freund ..... 266/239
3,708,088 1/1973 Lesher ..... 222/595

FOREIGN PATENT DOCUMENTS 1250606 9/1967 Fed. Rep. of Germany .
1758337 3/1972 Fed. Rep. of Germany .
2254946 5/1973 Fed. Rep. of Germany .
1289845 12/1962 France .
2105268 4/1972 France .
0917298 1/1963 United Kingdom .

OTHER PUBLICATIONS

Modern Metals, pp. 18–21, Feb. 1950.

*Primary Examiner*—L. Dewayne Rutledge
*Assistant Examiner*—S. Kastler
*Attorney, Agent, or Firm*—Jones, Tullar & Cooper

[57] ABSTRACT

A holding and/or smelting furnace for nonferrous metals is described, which is provided with an apportioning device for the automatic removal of a predetermined quantity of the nonferrous molten metal melt form an apportioning chamber. The apportioning chamber communicates via at least one inlet opening with the nonferrous molten metal melt. The nonferrous molten metal melt in the apportioning chamber is acted upon by compressed gas in order to discharge a predetermined quantity of the molten metal melt from an outlet opening. In order to attain a structurally simple design, the apportioning chamber is disposed integrally in the furnace and embodies a portion of a furnace shell. The inlet opening is closable by means of a reciprocable closure plunger through which a pressurized medium passes into the apportioning chamber. The reciprocating movement of the closure plunger and the delivery of the compressed gas are controlled as a function of time.

9 Claims, 4 Drawing Sheets

HIGH TEMPERATURE AND/OR MELTING FURNACE FOR NON-FERROUS METALS WITH DOSING DEVICE

BACKGROUND OF THE INVENTION

The present invention relates to a holding and/or smelting furnace for nonferrous metals having an apportioning device for the automatic removal of a predetermined quantity of the nonferrous molten metal from an apportioning chamber, which communicates with a chamber containing the nonferrous metal melt via at least one closable inlet opening and which can be acted upon by a compressed gas in order to emit a predetermined quantity of molten metal from an outlet opening.

Furnaces of this kind are generally used for scooping out a predetermined quantity of the particular nonferrous molten metal and deliver it to a die casting machine. The predetermined quantity to be removed depends on the size of the cast part to be produced in the die casting machine.

In a furnace known from German laid-open patent application DE-OS 29 14 810, the apportioning chamber is suspended on one lever arm of a beam of a weighing apparatus, and a separate closure element having a drive mechanism is provided. This arrangement is relatively complicated in structure and is expensive in view of the structural parts that are used.

SUMMARY OF THE INVENTION

It is the object of the present invention to devise a furnace for nonferrous metals which is simpler in structure.

This object is attained in a furnace for nonferrous metals of the above-mentioned general type in that the apportioning chamber is disposed in the furnace in a stationary manner, and preferably in the vicinity of the bottom thereof, with the inlet opening being closable by a reciprocating closure plunger containing a compressed gas delivery line and with the reciprocation of the closure plunger and the delivery of the compressed gas being controlled in accordance with weight or time.

In the holding and/or smelting furnace according to the invention, in a simple manner, a stationary apportioning chamber is utilized, thereby eliminating moving parts in the immediate vicinity of the furnace, which renders the apportioning device, in particular, less vulnerable to malfunction. Since the reciprocatable closure plunger also contains the compressed gas delivery line, the structure of the apportioning chamber in particular is simplified. A further advantage is that the nonferrous molten metal can be drawn from more-favorable areas within the furnace, since because of its stationary disposition the apportioning chamber can be disposed at the lowest point of the nonferrous metal melting bath.

Furthermore, the relatively small apportioning chamber is always full; thus the level of the bath at the outlet is always the same, only small quantities of compressed gas are required, and apportioning can be accomplished extremely quickly.

According to a preferred exemplary embodiment of the present invention, the apportioning chamber is disposed in an integrated manner in the furnace and embodies a portion of a furnace shell. As a result, the apportioning chamber can simply be provided simultaneously when the furnace shell is manufactured, and at the same time it can be disposed at the location which is most favorable for operation, both in terms of the removal of the nonferrous molten metal for the apportioned discharge and in terms of the discharge opening provided in the furnace.

It is efficacious for the integrated apportioning chamber to discharge directly via an inclined riser of predetermined flow cross section or indirectly via an inclined groove in a tapered discharge end of the furnace, so that the furnace can be moved close to the associated die casting machine substantially without interposing other elements for transporting the molten metal.

According to another exemplary embodiment of the present invention, the apportioning chamber is inserted as a separate structural component into the nonferrous molten metal in a scoop chamber. As a result, it is possible to provide even existing smelting and/or holding furnaces with an apportioning device of this kind retroactively, so that these furnaces can be made more efficient.

The determination of the quantity to be furnished to the die casting machine, that is, the accurate apportioning of this quantity, can be controlled in a particularly simple manner by means of the time relay device, which at a predetermined flow cross section and predetermined gas pressure is adjustable to a predetermined time. However, it is also possible, as in another exemplary embodiment of the present invention, to have the outlet opening of the apportioning chamber discharge in the vicinity of a weighing device, the indicator of which controls how long the compressed gas will be imposed.

An inert gas, such as nitrogen, is preferably used as the compressed gas; this has the advantage that it remains neutral with respect to the nonferrous molten metal, in particular molten aluminum.

Further details and embodiments of the invention will be understood from the ensuing description, in which the invention is described and explained in detail in terms of the exemplary embodiment shown in the drawing. Shown are:

DETAILED DESCRIPTION OF THE PREFERRED EMBODIMENTS

Figure 1:
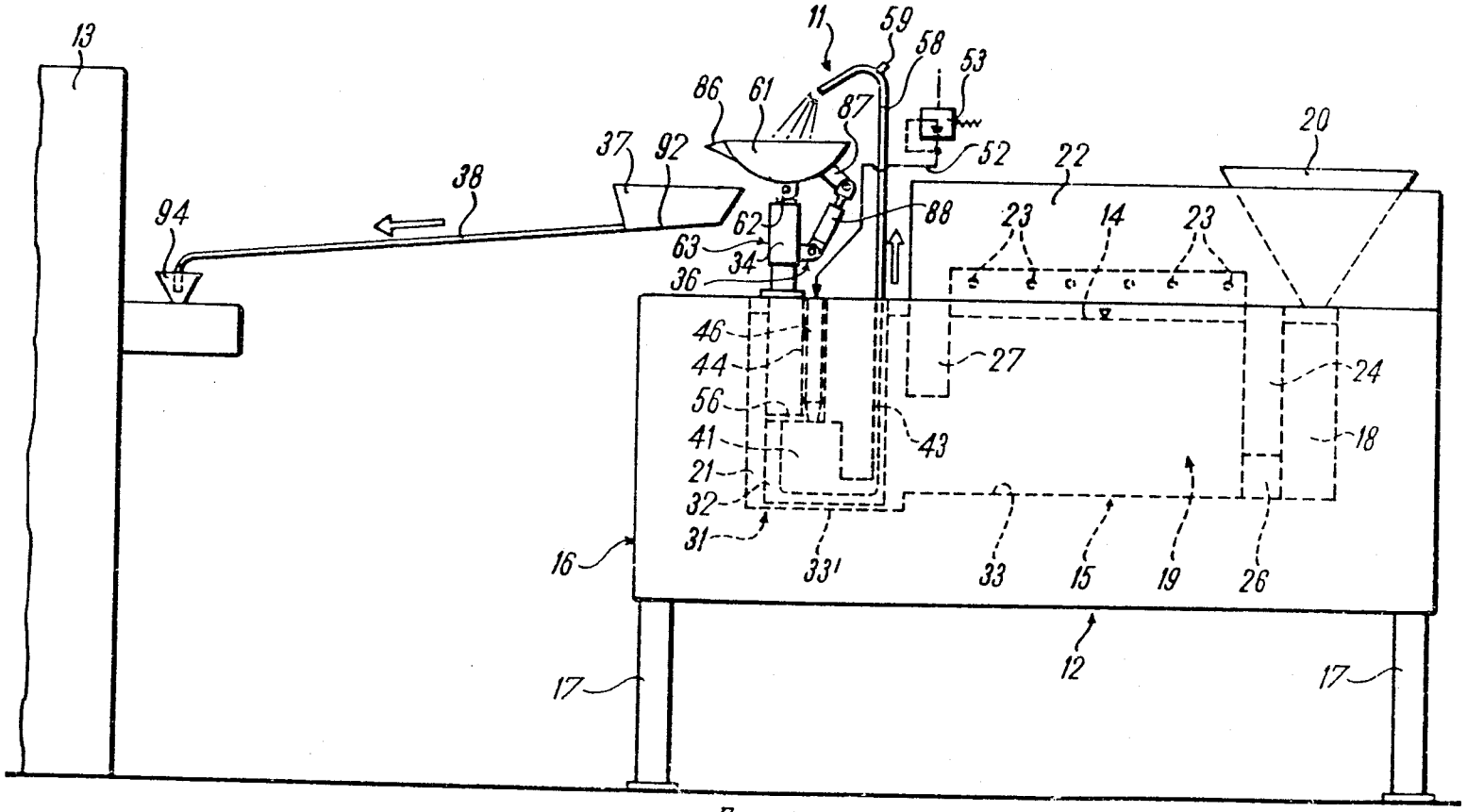
FIG. 1, which is a schematic illustration of an apportioning device according to an exemplary embodiment of the present invention by way of which a holding furnace communicates with a die casting machine.
Figure 4:
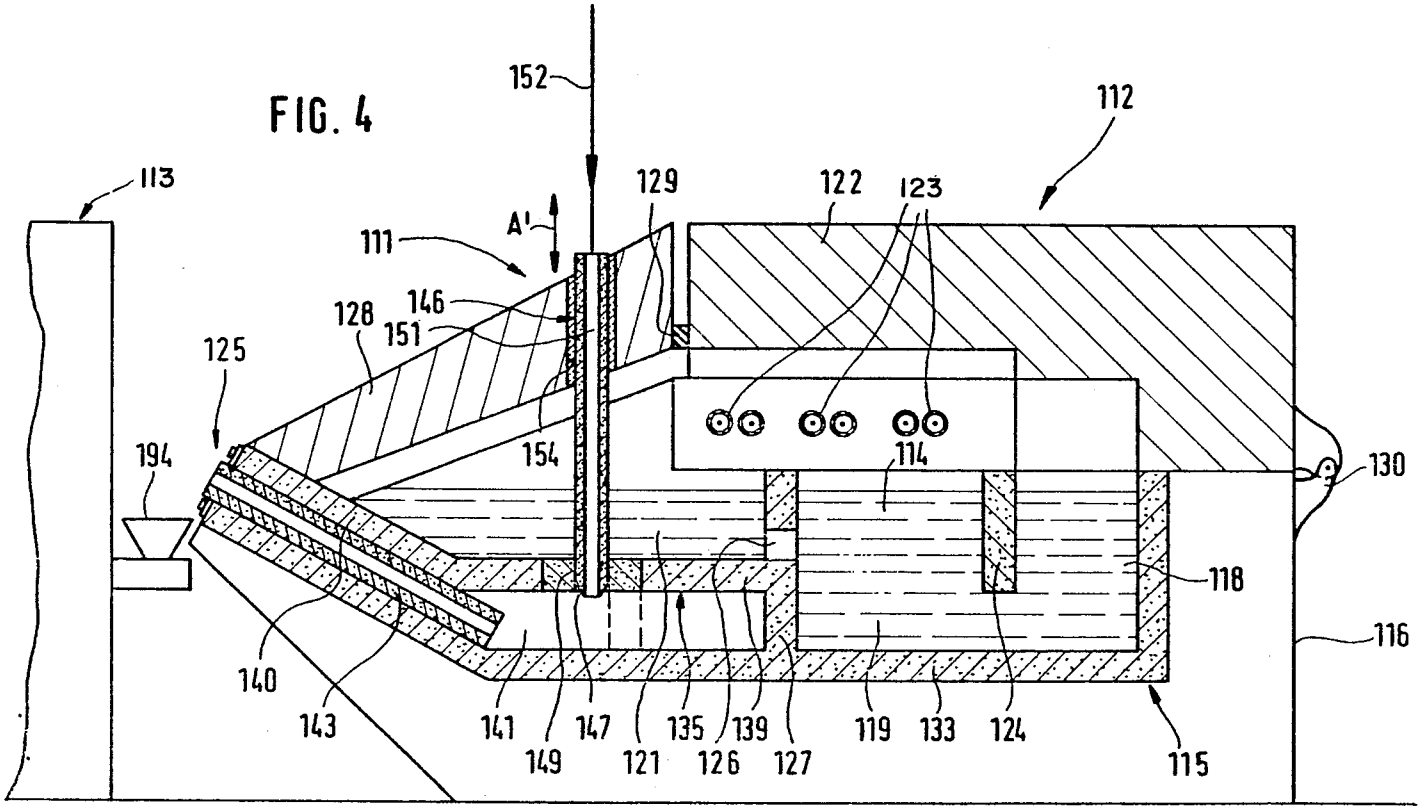
FIG. 4, which is an illustration of a smelting/holding furnace having an integrated apportioning device according to another exemplary embodiment of the present invention.
Figure 5:
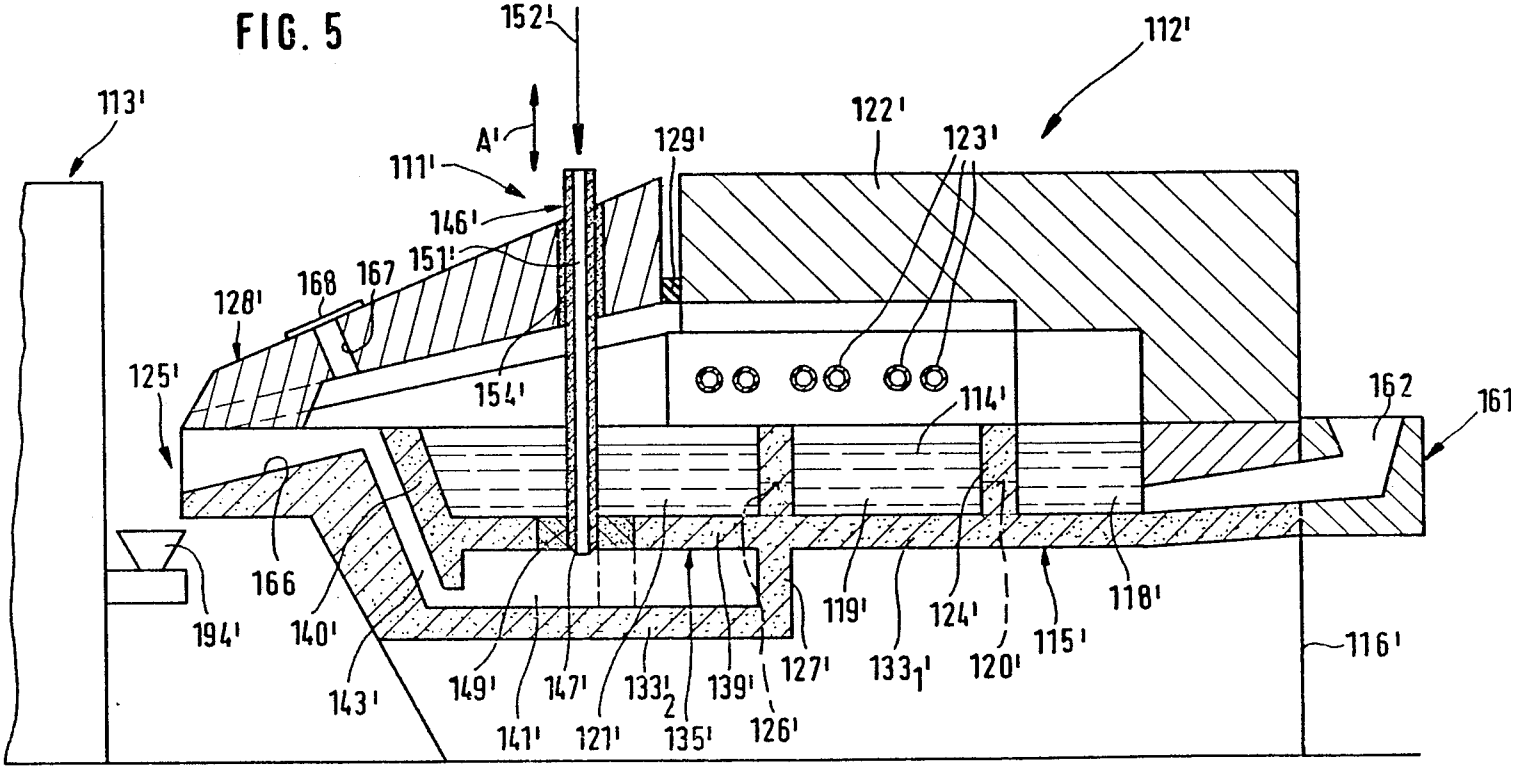
FIG. 5, which is a smelting/holding furnace having an integrated apportioning device according to a further exemplary embodiment of the present invention.

According to FIGS. 1, 4 and 5, the apportioning device 11, 111, or 111' according to the invention serves to convey a predetermined quantity of a nonferrous molten metal 14 from a holding furnace 12 or combined smelting/holding furnace 112 or 112' to a die casting machine 13, 113 or 113', in which this quantity of nonferrous molten metal is processed. It is understood that the apportioning device 11 can be used not only in combination with a holding furnace 12 but also with a smelting furnace or a combined smelting/holding furnace.

The holding furnace 12 shown in FIG. 1 has a housing 16 disposed on legs 17, and in this housing is disposed a shell 15 that is well insulated by means of a refractory lining and has three chambers, namely a filling chamber 18, a holding chamber 19 and a scoop chamber 21. A lid 22 is disposed above the filling chamber 18 and holding chamber 19; the filling chamber 18 is provided with a filling funnel 20. Electric heating elements 23 are disposed on the inside of the lid 22, in the area above the holding chamber 19, for indirectly heating the nonferrous molten metal 14. Between the filling chamber 18 and the holding chamber 19, there is an upright bulkhead or barrier 24, which in an area near the bottom 33 of the shell is provided with an opening 26 the cross section of which is substantially smaller than that of the shell 15 or scoop chamber 21. While the barrier 24 extends as far as the bottom and leaves only the small opening 26 free, a second bulkhead or barrier 27 is provided between the holding chamber 19 and the scoop chamber 21, which is disposed below one end of the lid 22 in the form of a strip extending transversely over the shell 15, and the free front edge of which is disposed at a predetermined distance apart from the bottom 33 of the chamber 19 or 21. This second barrier 27 extends into the nonferrous molten metal 14 to about half the depth of the shell or chamber.

Figure 3:
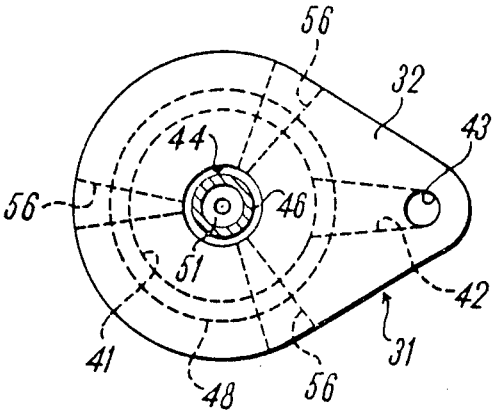
FIG. 3, which is a plan view viewed in the direction of the arrow III of FIG. 2.

The apportioning device 11, with its conveyor apparatus 31, is inserted into or immersed in the scoop chamber 21 of the holding furnace 12. The conveyor apparatus 31 has a housing 32, the bottom surface area of which is smaller than that of the scoop chamber 21 and which is seated upon the bottom 33' of the scoop chamber 21. The height of the housing 32, which has an approximately pear-shaped bottom surface as shown in FIG. 3, is approximately equal to the depth of the scoop chamber 21. The conveyor apparatus 31 is loosely connected with a weighing device 34, which is provided with a tipping device 36 and communicates with the die casting machine 13 via a catch funnel 37 and an inclined pipe 38.

Figure 2:
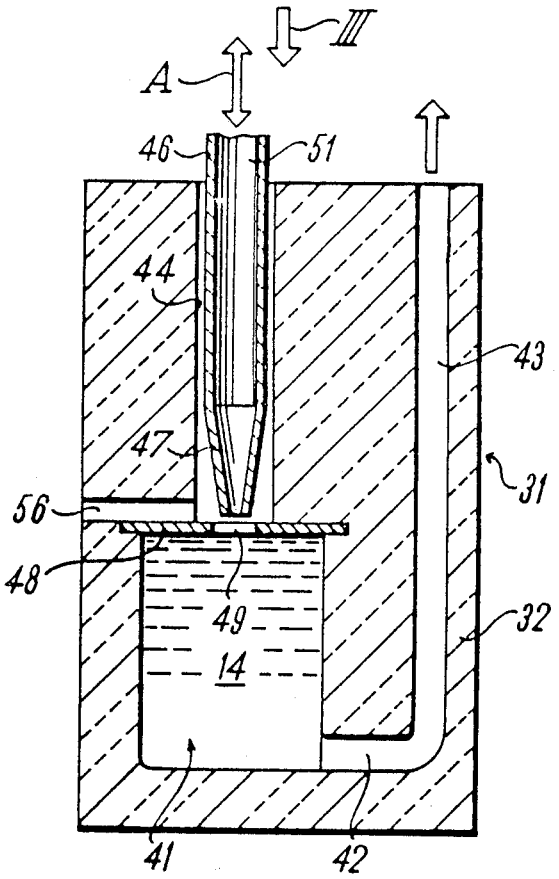
FIG. 2, which is a vertical section through a conveyor apparatus of the apportioning device of FIG. 1.

The apportioning device 11, which comprises the conveyor apparatus 31, the weighing device 34 and the tipping device 36, is structured as follows. The housing 32 of the conveyor apparatus 31, which is made of a high-quality refractory material, has an apportioning or storage chamber 41 cut into it in its lower portion in the form of a bore of large diameter, which toward the bottom communicates via a transverse bore 42 with a riser or outlet bore 43 leading vertically upward, and which emerges from the housing 32 at its upper end. Concentrically with the storage chamber 41, a guide bore 44 is provided, which begins at the upper end of the housing 32 and discharges into the storage chamber 41, and in which a closure plunger 46 is disposed such that it is movable back and forth, or up and down, as indicated by the double arrow A (FIG. 2). The closure plunger 46 is made to reciprocate in a manner not shown by a pneumatic drive apparatus. The closure plunger 46 is a thick-walled pipe, which at its forward end is provided with a conical taper, so that a nozzle-shaped orifice 47 is provided. In the transitional area between the guide bore 44 and the storage chamber 41, a closure plate 48 is provided, which is annular in embodiment and is held in the manner of a lid on the storage chamber 41. The annular closure plate 48 has an inlet opening 49, which is closable by the nozzle orifice 47 of the closure plunger 46. In other words, the inside diameter of the inlet opening 49 is somewhat larger than the smallest outer diameter of the nozzle orifice 47, so that the latter can move into the inlet opening 49 and close it with its outer cone. The closure plunger 46 and the closure plate 48 are of heat-proof ceramic material. The through bore 51 in the closure plunger 46 communicates with a pipe 52, which communicates via a pressure regulator 53 with a pressure pump or a network of compressed air, such as that used in factories (FIG. 1).

As seen in FIGS. 2 and 3, a plurality of inlet openings—three, in the exemplary embodiment—are disposed distributed over the circumference in the housing 32 of the conveyor apparatus 31 in the form of horizontal slits 56, which extend radially inward from the outer circumference of the housing 32 and discharge into the guide bore 44 directly above the closure plate 48. As shown in FIG. 3, these slits 56 are uniformly distributed over the circular portion of the outer circumference, while the tapering portion of the pear-shaped circumference is free of such slits. The slits 56 extend conically from the outside toward the inside.

The vertically extending outlet bore 43 communicates at its end emerging from the housing 32 with a feed pipe 58 of heat-proof ceramic. The feed pipe 58 has a bend of more than 90° at its end region remote from the outlet bore 43, in which bent region a ventilation opening 59 is disposed. The free [end] of the feed pipe 58 is disposed above a weighing or receiving pan 61 of the weighing device 34. The receiving pan 61 is secured on a spring scale 63 such that it is tiltable about a horizontal shaft 62; the spring scale 63 is seated on the housing 32 and secured there.

The spring scale 63 substantially comprises an upper and outer cylindrical portion, on which the receiving pan 61 is secured, and a lower, inner cylindrical portion which is secured on the housing 32. The upper, outer portion coaxially surrounds and grips the lower, inner portion, and an adjustable compression spring is disposed between the two and determines the force to be exerted in order to move the upper, outer portion downward over the lower, inner portion. The spring scale 63 or weighing device can thus be adjusted in terms of the apportioning weight. In a manner not shown, the spring scale 63 furthermore has two electrical contacts movable relative to one another, which come into operative engagement with one another and interrupt the delivery of the molten metal once the established apportioning weight has been attained.

The tiltable receiving pan 61 is provided at one end with a pouring spout 86 and opposite that is connected to a lever linkage 87, the other end of which is articulatedly connected to a pneumatic piston-cylinder unit 88, the fixed end of which is secured to the cylinder 72 or 84 of the weighing device 34. The weighing device is thereby combined with the tipping device 36.

The catch funnel 37 is disposed below the tiltable receiving pan 61 and its inclined bottom 92 is connected at the lower end with the pipe 38, which is likewise disposed on an incline and which discharges into a feed funnel 94 in the die casting machine 13.

The apportioning device 11 according to the invention functions as follows:

Since the conveyor apparatus 31 is inserted completely into the scoop chamber 21 of the holding furnace 12 or of a smelting furnace for nonferrous metals, then in the open state of the closure plunger 46 (as shown in FIG. 2), nonferrous molten metal can flow out of the scoop chamber 21 into the storage chamber 41 of the apportioning device 11 until the storage chamber 41 is full. The delivery of molten metal is effected from a region of medium depth in the scoop chamber 21, in which the molten metal is optimally calm and deaerated. Now if a predetermined quantity of the nonferrous molten metal is to be delivered from the scoop chamber 21 to the die casting machine 13, then the closure plunger 46 is moved downward, so that with its nozzle orifice 47 it closes the inflow opening 49 in the closure plate 48 and there is no further communication between the storage chamber 41 and the inflow slits 56. Once this has taken place, pre-heated compressed air is delivered via the pressure regulator 53 and the pipe 52 and the central bore 51 in the closure plunger 46, so that the nonferrous molten metal 14 located in the storage chamber 41 is put under pressure. Under this pressure, the nonferrous molten metal 14 is moved through the ascending outlet bore 43 into the feed pipe 58 and thus onto the tiltable receiving pan 61. The delivered quantity of nonferrous molten metal 14 is weighed by the weighing device 34, the scale 63 carrying the arrangement of contacts on its stationary and movable upper and lower parts; when a certain predetermined weight or quantity of the nonferrous molten metal 14 is attained, contact is made with the compressed air delivery means, for instance the pressure regulator 53, which thereupon immediately prevents any further delivery of compressed air. The closure piston can thereupon be returned to its initial position, so that communication between the scoop chamber 21 of the holding furnace 12 and the storage chamber 41 of the conveyor apparatus 31 is reestablished. In this condition, the ventilation opening 59 in the feed pipe 58 is uncovered as well, so that the nonferrous molten metal 14 located in the feed pipe 58 can flow back without delay into the storage chamber 41. At the same time as contact is made at the scales 63 upon attaining the predetermined quantity of nonferrous molten metal, a contact is also made with the tipping device 88, which thereupon tips the receiving pan 61, so that the particular weighed-out quantity of nonferrous molten metal 14 can flow via the catch funnel 37 and the pipe 38 into the die casting machine 13. Once the die casting machine 13 has processed this particular quantity of nonferrous molten metal, a new cycle can begin; that is, a particular quantity of nonferrous molten metal is again conveyed from the storage chamber 41 to the weighing device 34. It is efficacious if the compressed air (in the range from 0.5 to 0.8 bar) drawn from a compressed air network is pre-heated, so that a crust will not form on the nonferrous molten metal.

The combined smelting and holding furnace 112 shown in FIG. 4 is provided with an apportioning device 111 which is provided with an apportioning or storage chamber 141 that is integrated into the furnace 112. The smelting/holding furnace for nonferrous molten metal 114 has a housing 116, which is approximately cubic over a substantial portion and tapers from the two side walls and from the bottom toward a discharge end 125. In the vicinity of the discharge end 125, the housing 116 is covered by a substantially rigid lid 128 ascending obliquely from the discharge end, adjoining which with a seal 129 in between is a substantially rectangular lid 122, which is articulated on a hinge 130 disposed on the end of the housing 116 remote from the discharge end 125. The lid 122, which is approximately L-shaped in cross section, has heating elements 123 over a predetermined area on its underside.

The furnace housing 116 has a shell 115 which is well insulated with respect to the outside by a refractory lining and is provided with four chambers, namely a filling chamber 118, which at the same time is the smelting chamber for the solid nonferrous material introduced into it, a holding chamber 119, the apportioning chamber 141 and an intermediate chamber 121, which communicates at one end with the holding chamber 119 and at the other with the apportioning chamber 141. Between the filling or smelting chamber 118 and the holding chamber 119, there is a vertical bulkhead or barrier 124, which takes the form of a strip extending transversely across the shell 115 and the lower free edge of which is spaced apart by a certain distance from the bottom 133 of the chamber 118 or 119. Remote from the barrier 124, the holding chamber 119 is partly separated from the intermediate chamber 121 and completely separated from the apportioning chamber 141 by a second vertical bulkhead or barrier 127. Communication between the holding chamber 119 and the intermediate chamber 121 is provided by an opening 126 in the barrier 127, the cross section of which is substantially smaller than that of the shell 115 and which is disposed at the level of a partition 135, the top of which forms the bottom of the intermediate chamber 121. The two barriers 124 and 127 are disposed with respect to the heating elements 123 disposed on the pivotable lid 122 such that the heating elements 123 are distributed over substantially the entire surface area of the holding chamber 119 and over part of the surface area of the intermediate chamber 121.

The partition 135 between the intermediate chamber 121 and the apportioning chamber 141 has a horizontal part 139, which is adjoined by an obliquely ascending or inclined part 140, which extends as far as the discharge end. The apportioning chamber 141 is defined by the horizontal part 139 of this partition 135, the opposite horizontal region of the bottom of the shell and the lower part of the vertical barrier 127, and the corresponding side wall regions of the shell 115. A riser 143 is disposed between the inclined part 140 of the partition 135, the opposite, inclined region of the shell bottom 133 and correspondingly extending side wall regions of the furnace housing 116, leading obliquely upward from the interior of the apportioning chamber 141 to the discharge end 125 of the shell 115.

An inlet opening or bore 149 is cut into the horizontal part 139 of the partition 135, forming a closable connection between the intermediate chamber 121 and the apportioning chamber 141. This inlet opening 149 is closable by a closure plunger 146 in the form of a thick-walled pipe having a through bore 151. The closure piston or pipe 146 is passed through a through opening 154 in the rigid lid 128 and is mechanically coupled at one end with a drive mechanism, for instance of the pneumatic type, for movement up and down as indicated by the double arrow A' and is coupled at the other end with a compressed air pipeline 152. The pipe 146 is supported in the rigid lid 128 such that although it slides it is also heat insulated, and on its inner forward end it is provided with a nozzle-like orifice 147, which is formed by a conical taper. The dimensions of the orifice 147 are such that, as shown in FIG. 5, it is capable of closing off the inlet opening 149 from the intermediate chamber 121 to the apportioning chamber 141. Here again, the closure plunger 146 is of heatproof ceramic.

The closure plunger 146 is also connected via the pipeline 152 with a pressure regulator, not shown, and a pressure pump or compressed air network such as that used in factories.

The preferably pneumatic drive mechanism, not shown, for movement up and down of the closure plunger 146 and a blocking valve, again not shown, in the compressed air pipeline 152 are connected with a time relay, also not shown, in such a manner that when the inlet opening 149 is closed as shown in FIG. 4, compressed air is supplied for the purpose of discharging nonferrous molten metal in an apportioned manner, and such that after a predetermined apportioned quantity of molten metal has been discharged, the compressed air is shut off and the closure plunger 146 is raised, so that molten metal can once again flow from the intermediate chamber 121 into the apportioning chamber 141.

The function of this combined smelting and holding furnace 112 is as follows: Because of the conical shape of the discharge end 125, the furnace 112 can be brought quite close to or immediately next to a feed funnel 194 of a die casting machine 113. When the inlet opening 149 is opened by the closure plunger 146, nonferrous molten metal flows into the apportioning chamber 141. After the closure of the inlet opening 149, compressed air is imposed upon the apportioning chamber 141 by means of the closure plunger 146, so that nonferrous molten metal flows through the riser 143 out of the discharge end 125 into the die casting machine funnel. Since the die casting machine 113 must be supplied with a specific quantity of nonferrous molten metal for a particular part that is to be cast, the delivery of compressed air is controlled in accordance with time; that is, via a time relay, not shown, the discharge quantity is determined based on the known flow cross section and pressure imposed. After the delivery of compressed air is terminated by the time relay, the closure plunger 146 is opened again, so that the apportioning chamber 141 can be refilled. Since the apportioning chamber 141 is relatively small, the imposition of pressure by means of compressed air can be effected directly, that is, without a preceding inlet pressure container.

The smelting and holding furnace 112' shown in FIG. 5 is fundamentally similar in structure to the smelting and holding furnace 112 of FIG. 4 and also functions substantially similarly. The reference numerals have therefore been provided with a prime. In the ensuing discussion, only the differences between the furnace 112' of FIG. 5 and the furnace 112 of FIG. 4 will be addressed. In the smelting and holding furnace 112', the bottom $133_2'$ of the apportioning chamber 141' is set deeper than the common bottom $133_1'$ of the holding chamber 119' and filling chamber 118'. As a result, it is possible to empty the furnace 112' completely. Furthermore, the opening 120' between the filling chamber 118' and the holding chamber 119' and the opening 126' between the holding chamber 119' and the intermediate chamber 121' are relatively narrow and are disposed offset from one another in the direction of the width of the chambers. The inlet opening 149' from the intermediate chamber 121' to the apportioning chamber 121' is provided in a ceramic insert, as in the exemplary embodiment of FIG. 4.

A further difference is that the riser 143', which begins at the apportioning chamber 141', is not carried directly to the discharge end 125' but instead discharges ahead of this end into an open groove 166, which is cut from the top of the shell into the aluminum-repellent refractory concrete of which the furnace shell is made. The riser 143', too, is provided merely as a bore in the refractory concrete. The open groove 166 extends from at the outlet end of the riser 143' at a downward inclination toward the discharge end 125'. Thus the riser 143' is steeper than in the exemplary embodiment of FIG. 4.

The apportioning device 111' is substantially the same in the furnace 112' according to FIG. 5 as the apportioning device 111 in the furnace 112 of FIG. 4. The only difference is that the oblique lid 128' is adapted to the furnace 112' such that in the closed state it shields the open groove 166 from the outside. Furthermore, this oblique lid 128 has an oblique bore 167, which is closable by means of a flap 168 and which extends beyond and in alignment with the riser 143', so that stoking can be done through the riser 143' from the outside as needed. The smelting and holding furnace 112' also has an extension 161, which is provided with a filling funnel 162 that discharges into the filling or smelting chamber 118. In this manner, liquid material can also be fed directly into the furnace 112'. The lid 122' in this exemplary embodiment is articulated on one of the long sides so that it can be raised.

In this exemplary embodiment, it is not compressed air which is imposed upon the apportioning chamber 141' for the purpose of discharging an apportioned amount of nonferrous molten metal, but rather nitrogen or some other inert gas, which has the advantage that such gases behave neutrally with respect to the nonferrous molten metal, in particular to a molten aluminum. Since the apportioning chamber 141' is relatively small and is always substantially completely full, only very little nitrogen or the like is ever required for the apportioned discharge of the molten metal; thus in an advantageous manner, bottled nitrogen can be used.

It will be understood that in the exemplary embodiments of FIGS. 1–3 and FIG. 4 as well, an inert gas such as nitrogen can be used instead of the compressed air. It will also be understood that the apportioning device 11 according to FIGS. 1–3 can be provided with a time relay instead of with the weighing device, or that the apportioning device 111 or 111' can be provided with a weighing device instead of with the time relay. It is further understood that in the furnaces 12, 112, 112', sufficient insulation against heat is provided in a manner not shown, for instance in the form of fiber plates, between the shell 115 and the housing 116.

I claim:

1. A holding or smelting furnace for nonferrous metals, comprising:

a housing containing a quantity of nonferrous molten metal melt, said housing having a bottom surface;

an apportioning chamber formed integral with the housing adjacent to the bottom surface, said apportioning chamber having an inlet for receiving metal melt and an outlet through which a predetermined quantity of the molten metal melt is removed from the furnace; and a closure plunger for engagement with the inlet of the apportioning chamber to close said inlet, said closure plunger defining a passage for communicating with the apportioning chamber when the closure plunger is in engagement with said inlet, whereby a pressurized medium is communicated through said passage to the molten metal melt in the apportioning chamber when the closure plunger is in engagement with said inlet to thereby displace the molten metal melt in the apportioning chamber out said outlet as a function of time.

2. The holding or smelting furnace as defined in claim 1, wherein:

the housing comprises a shell structure, said shell structure partly defining the apportioning chamber.

3. The holding or smelting furnace as defined in claim 2, further wherein:

said shell structure partly defines a holding chamber and an intermediate chamber, said apportioning chamber being located below the intermediate chamber.

4. The holding or smelting furnace as defined in claim 2, further wherein:

said shell structure partly defines said outlet, such that said outlet is formed as an inclined riser from said apportioning chamber.

5. The holding or smelting furnace as defined in claim 4, further wherein:

the inclined riser communicates with the bottom of said apportioning chamber.

6. The holding or smelting furnace as defined in claim 2, further wherein:

said shell structure partly defines said outlet, such that said outlet is formed partly as an inclined riser from said apportioning chamber and a tapered outlet groove extending from the inclined riser.

7. The holding or smelting furnace as defined in claim 6, further wherein:

the inclined riser communicates with the bottom of said apportioning chamber.

8. The holding or smelting furnace as defined in claim 1, wherein:

the closure plunger comprises heat-proof ceramic material.

9. The holding or smelting furnace as defined in claim 1, further comprising:

lid means connected to said housing, wherein:

said lid means includes a through opening through which said closure plunger extends for reciprocal movement relative thereto.

* * * * *